US007950640B2

(12) United States Patent
Bolza-Schünemann et al.

(10) Patent No.: US 7,950,640 B2
(45) Date of Patent: May 31, 2011

(54) ROTARY PRINTING PRESS AND METHOD FOR PRODUCING A NEWSPAPER PRODUCT IN TABLOID FORMAT

(75) Inventors: Claus August Bolza-Schünemann, Würzburg (DE); Günther Oskar Eckert, Zellingen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 205 days.

(21) Appl. No.: 12/311,459

(22) PCT Filed: Feb. 21, 2008

(86) PCT No.: PCT/EP2008/052107

§ 371 (c)(1),
(2), (4) Date: Mar. 31, 2009

(87) PCT Pub. No.: WO2008/101980

PCT Pub. Date: Aug. 28, 2008

(65) Prior Publication Data

US 2009/0257810 A1 Oct. 15, 2009

(30) Foreign Application Priority Data

Feb. 24, 2007 (DE) ..... 10 2007 009 123

(51) Int. Cl.
*B41F 13/56* (2006.01)

(52) U.S. Cl. ..... 270/21.1; 270/5.02; 270/16; 101/227

(58) Field of Classification Search ..... 101/224, 101/225, 226, 227, 228; 270/5.01, 5.02, 270/20.1, 21.1, 41, 16
See application file for complete search history.

(56) References Cited

U.S. PATENT DOCUMENTS 4,538,517 A * 9/1985 Michalik et al. ..... 101/227
(Continued)

FOREIGN PATENT DOCUMENTS

DE 10 2005 031 010 10/2006
(Continued)

OTHER PUBLICATIONS

"Postleitzahl (Deutschland)", http://de.wikipedia.org/wiki/Postleitzahl_(Deutschland), Nov. 9, 2010, 16 pp. (in German).

(Continued)

*Primary Examiner* — Ren Yan
(74) *Attorney, Agent, or Firm* — Jones, Tullar & Cooper, P.C.

(57) ABSTRACT

A rotary printing press is usable for producing a newspaper product in tabloid format. The printing press has at least one printing unit which is configured so that it prints a web with printed pages in a horizontal tabloid format. A part web, which is formed by slitting a web, is provided with a fold by a plough folder and that is arranged in the path of travel of the web. The web is folded with a first edge region, which is printed with a narrow printed image section, as a folded portion, along a first folding line by the plough folder. A fold former is arranged after the plough folder. The part web is printed with only one horizontal page in tabloid format and is also printed with a narrow printed section on an adjacent edge region. The part web and the fold former are arranged in the partial web travel direction so that the part web, which is folded along one side by the plough folder, runs into the folding former offset. The center of the partial web is not aligned with the former tip but instead is offset with respect to that former tip.

24 Claims, 8 Drawing Sheets

U.S. PATENT DOCUMENTS

| | | | | |
|---|---|---|---|---|
| 5,303,909 | A * | 4/1994 | Maylaender | 270/5.01 |
| 5,328,437 | A * | 7/1994 | Maylander et al. | 493/357 |
| 6,024,684 | A * | 2/2000 | Maylander et al. | 493/346 |
| 6,298,781 | B1 * | 10/2001 | Dufour | 101/483 |
| 6,827,012 | B1 * | 12/2004 | Palmatier | 101/225 |
| 7,156,019 | B2 | 1/2007 | Herbert et al. | |
| 7,243,404 | B2 * | 7/2007 | Weiss | 26/71 |
| 7,765,925 | B2 | 8/2010 | Eckert et al. | |
| 2004/0144271 | A1 * | 7/2004 | Herbert | 101/219 |
| 2008/0257182 | A1 | 10/2008 | Eckert et al. | |

FOREIGN PATENT DOCUMENTS

| | | | |
|---|---|---|---|
| EP | 1 329 313 | A2 | 1/1999 |
| WO | WO 03/1179 | A3 | 4/2003 |
| WO | WO 03/031179 | A2 | 4/2003 |
| WO | 2005105447 | A1 | 11/2005 |
| WO | WO 2005/105447 | A1 | 11/2005 |

OTHER PUBLICATIONS

"Postal Codes in Germany", http://en.wikipedia.org/wiki/Postal_codes_in_Germany, Dec. 23, 2010, 3 pp. (in English).

Walenski, Wolfgang. "Der Rollen Offset Druck, Geschichte Modeme Technnik Materiallen", pp. 80-82, 194-195, and 220-221, Nov. 1996.

Man Roland, "Qualitateoffset der 90er Jahns Das Imnis Konzert im 16-Seisen-Bereich: Polyman and Rotoman", Cover, pp. 3-22, and 3 end pages, 1922 (in German).

* cited by examiner

ROTARY PRINTING PRESS AND METHOD FOR PRODUCING A NEWSPAPER PRODUCT IN TABLOID FORMAT

CROSS-REFERENCE TO RELATED APPLICATIONS

This application is the U.S. national phase, under 35 U.S.C. 371, of PCT/EP 2008/052107, filed Feb. 21, 2008; published as WO 2008/101980 A1 on Aug. 28, 2008 and claiming priority to DE 10 2007 009 123.2, filed Feb. 24, 2007, the disclosures of which are expressly incorporated herein by reference.

FIELD OF THE INVENTION

The present invention is directed to a rotary printing press and to a method for producing a newspaper product in tabloid format. A printing unit, with at least one printing couple, is usable to print a web with printed pages in horizontal tabloid format. A partial web is obtained by cutting the web longitudinally and is provided with a plough fold. A first edge area of the partial web is folded over. That first edge area is printed with a narrower printed image section. A former is located downstream of the plough fold forming device.

BACKGROUND OF THE INVENTION

Individual pages or sections of printed products, and especially of newspaper products, which have been printed in broadsheet format, such as, for example, title pages, can be provided with sections that are particularly effective for advertising purposes. This can be accomplished by the use of various pre-folding devices, such as a plough fold, for example, which generate supplementary longitudinal folds.

Sections of this type have not been able to be produced in newspaper products in tabloid format. This is because a web, that is used to produce a newspaper product in tabloid format, as opposed to broadsheet format, is printed horizontally, not vertically, and a first fold, also called the nose, which is usually generated on a former, is slit open in this case. A so-called reading fold, which is formed as the second fold, extends crosswise to the direction of paper travel.

With newspaper products which are configured in tabloid format, in order to generate a section on the title page or on the first page of a section in the manner used to produce a newspaper product in broadsheet format using a plough fold, as described in the prior paragraphs, a section, that is longer in the direction of web travel, would have to be produced, and the projecting section would have to be folded in opposite to the cross fold direction. This type of production is not feasible for performance at a reasonable cost using rotary printing presses or folding units of rotary printing presses that have constant cut-off lengths.

Nevertheless, folded-in sections, which have a fold line that extends transversely to the reading fold, can offer interesting sections that can be used effectively for advertisement in newspaper products in tabloid format, assuming that suitable folding elements for the interior and exterior pages of the newspaper product are available. Interior pages, with edges that project beyond the title page, either at the head and/or at the foot of the newspaper product, and which interior pages are called pop-ups, can also be desirable.

A rotary printing press is known from WO 2005/105447 A1. Using that printing press, printed products can be produced in a special format using a plough fold, and resulting in the production of printed products that are arranged in tabloid format when they are folded together. In this case, a plate cylinder is loaded with printing formes that extend over its entire length. Each such printing forme has a narrow print image in the area near its end surfaces, and has print images, in a horizontal tabloid format, in the center area of the printing forme. A web of special width is then printed, at its center, with four horizontal tabloid pages arranged side by side. The web is also printed, at its edge areas, with the width of each such printed edge area corresponding to approximately half the height of one tabloid page, and is printed with half tabloid pages, also arranged horizontally. The total resulting web width corresponds to approximately five times the height of one tabloid page. After printing of the web, the edge areas of the web are each folded in by a plough fold. After this web edge folding, the resultant folded web, which is now four horizontal tabloid pages in width, is cut lengthwise at the center into two partial webs of equal width. The two partial webs, which are each already folded along one edge area, are then either placed one on top of another and are then fed to a shared former, or are fed straight through to a group of two formers. The former or formers fold the resultant ribbon, which may be comprised of the several partial webs placed one on top of another, or the partial webs, at the center, with the former fold direction being opposite to the direction of the plough fold. A cross fold can then be made. The result is the formation of printed products comprised of two tabloid pages that are folded lengthwise on top of one another, with backs together, when the cross fold is opened, and with one folded portion folded in toward the tabloid pages.

A printing press is known from DE 10 2005 031 101 A1. Using this printing press, printed pages arranged in horizontal tabloid format can be printed on a web as pop-up products, such as, for example, products comprising a page that projects beyond the actual product dimensions on one side of the product, can be produced by using printed images and partial webs of different widths.

SUMMARY OF THE INVENTION

The object of the present invention is to provide a rotary printing press and to provide a method for operating the rotary printing press for producing a newspaper product in tabloid format.

The object is attained, in accordance with the present invention by the provision of a printing unit with at least one printing couple usable to print a web in a horizontal tabloid format. A partial web is obtained by cutting the web longitudinally and a plough fold is used to fold a first edge area of the partial web. The folded first edge area is printed with a narrower printed image section. A former is located downstream of the plough folder. The printed web is printed with only one horizontal page in tabloid format and is also printed on a second edge with a second narrower printed image section. The printed web, with the plough folded first edge area, is folded eccentrically by the former.

A rotary printing press in accordance with the present invention comprises at least one printing couple or at least one printing unit, which prints a web of material, such as, for example, a web of paper, or a web, in horizontal tabloid format. The resultant printed web, or at least a partial printed web, which may be obtained by cutting the printed web longitudinally, is preferably printed, on at least one-half its width, in a horizontal tabloid format. The width of this horizontal tabloid format corresponds to the height of one page. This web or partial web is also printed, in a remaining adjacent edge area on at least one side of the horizontal tabloid format, the width of which corresponds to the height of one page. The rotary printing press includes a folding unit having a plough fold, which folds in a first edge area of the printed web or partial web. A former is situated downstream from the plough fold, and is adjustable at least transversely to the direction of web travel and preferably over the entire web width. The former folds in a second edge area, which is optionally located on a side of the web or the partial web that is opposite to the first folded edge area, and in the same fold direction as the first folded edge area. This is done in order to produce a newspaper product in tabloid format, which product has at least one folded-in portion arranged at the head and/or at the foot of at least one interior page of the newspaper product, and which folded in portion or portions is or are folded in the same direction and transversely to a reading fold. This is accomplished using a web or a partial web, which has been printed in horizontal tabloid format and which is wider, in web width configuration, than the height of one tabloid page by the height of the folded-in portion or portions located at the head and/or at the foot of the interior page.

The printed edge area refers essentially to a printed strip of the web or partial web, which printed strip extends transversely to the direction of web travel. The printed edge area is situated on at least one side of the web or the partial web adjacent to a strip that is printed with a horizontal tabloid page, and which web or partial web is fed to the plough fold and then to the adjustable former, which is located downstream. If a partial web, which is obtained by longitudinally cutting a printed web, is fed to the plough fold and subsequently is fed to the adjustable former located downstream, then the edge area or areas, or edge strip or strips, are located not directly at the edges of the printed web, but at the edges of the printed, resultant partial web. Thus, the printed image of the partial web, which comprises the sections that have been printed in horizontal tabloid format, and the at least one edge strip, can be located at any point within the web.

One benefit to be achieved with the present invention is that the pages, which preferably are located in the interior of the newspaper product, can be folded at the foot of the pages by the use of the plough fold, and/or at the head of the pages by the use of a projection over the former nose of the former, which former is preferably configured as a balloon former of a folding unit having at least two former planes, and which former is adjustable transversely to the direction of web travel. The amount of the fold being formed by the former is dependent upon the lateral positioning of the adjustable former and the position of the plough fold, and upon the width of the web or partial web. In this manner, folded-in portions, that can be effectively used for advertisement, can be produced in a newspaper product in tabloid format. However, the folded-in portions can also be used to separate sections, which are located inside the newspaper product, from one another.

The folding unit preferably has at least two former planes, that may be situated one above another. The adjustable former is preferably configured as a balloon former which is arranged in an upper former plane, which upper former plane is arranged above a lower former plane. This allows the web, or the partial web, which is fed over the plough fold and the former, to be placed at any point on top of, underneath, or between the webs or the partial webs which are running over the lower former. The result is that the pages that have been provided with the folded-in portions can be positioned at any location within the newspaper product.

In accordance with one advantageous embodiment of the present invention, the adjustable former, which is configured as a balloon former, is arranged aligned above the former or the formers of the lower former plane.

One advantageous embodiment of the rotary printing press in accordance with the present invention provides that the adjustable former is configured with extra width. The result is that newspaper products in tabloid format can be produced with taller pages in the interior of the finished newspaper product, which taller pages then project as pop-ups at the head above the other pages of the newspaper product.

The adjustable former can also be arranged to be adjustable longitudinally in relation to the direction of travel of the web or the partial web. This will allow the production of pop-ups at the head in which the pin holes, as are desirable in tabloid products, lie not on the title page, but at the back of the product.

The folding unit of the rotary printing press preferably comprises at least one further longitudinal cutting device. This cutting device longitudinally cuts a part of the web that remains after separation of the partial web, which has been fed over the plough fold and then the adjustable former situated downstream, into partial webs, with the width of each such resultant partial web corresponding to the height of one tabloid page. The folding unit comprises at least one additional former, preferably arranged in a lower former plane, over which at least two resultant partial webs extending side by side, with the width of each such resultant partial web corresponding to the height of one tabloid page, are fed in such a way that the dividing line between the adjacent partial webs extends over the former nose of the lower former.

The folding unit of the rotary printing press in accordance with the present invention can further comprise at least one pair of cutting cylinders, which combine the web or the partial web, that is fed over the plough fold and the adjustable former, with webs or with partial webs that have optionally been fed over at least one additional former of the folding unit to form a ribbon, and which at least one pair of cutting cylinders cross cuts this ribbon into sections. The length of each resultant section corresponds to the width of a double tabloid page. The folding unit further comprises at least one pair of folding cylinders, which fold the resultant sections transversely to the direction of web travel.

The adjustable former is preferably arranged in such a way that the ribbon that is entering the pair of cutting cylinders from the former has the web or the partial web having the folded-in edge areas placed under the webs or the partial webs that have been fed over at least one additional former of the folding unit. The at least one folded-in portion can thus optionally be positioned on the panorama page of the finished newspaper product.

According to one particularly advantageous embodiment of the present invention, the folding unit of the rotary printing press has assemblies for use in perforating and/or for slitting open the folded-in portion in the area of the cross fold. The assemblies for accomplishing the perforating and/or the slitting open the folded-in portion, in the area of the cross fold can comprise a rhythmically running perforation and/or cutting device which may be arranged upstream of the adjustable former in the direction of web travel, and which perforates and/or slits open the folded-in portion in the area of the cross fold. The result of the use of such a perforating and/or slitting assembly is a folded-in portion which can be opened up even when the newspaper product is unopened, or in other words which can be opened up when the reading fold is unopened or is not fully opened.

The web that is printed by the printing couple or by the printing unit, or the partial web which is obtained by cutting a previously printed web longitudinally, preferably has a total width that corresponds to the height of two tabloid pages. With this provision, no special format for the web width is required, because the total width of the web can correspond to a whole number multiple of the height of one tabloid page.

Preferably, the width of the web that is printed by the printing couple or by the printing unit corresponds to an even-numbered multiple of the height of one tabloid page. At least one partial web, the width of which corresponds to the height of two tabloid pages, is obtained from this web by longitudinal cutting. This at least one partial web can be fed to the plough fold and to the adjustable former, which is situated downstream. A total of the widths of the edge areas that are folded in by the plough fold, and by the adjustable former, corresponds to the height of one tabloid page. This results in the production of folded-in portions at the head and/or at the foot of an interior double page of the finished newspaper product, which folded-in portions span both interior pages of the double page.

One advantageous embodiment of the rotary printing press in accordance with the present invention provides for the width of the web to correspond to the height of six tabloid pages. The partial web, that is fed over the plough fold and the adjustable former, is one-third the width of the web. The plough fold and the former each fold in an edge area of the partial web that is one-twelfth the width of the original web. This results in the formation of folded-in portions at the head and at the foot of an interior double page of the finished newspaper product, which folded-in portions span the entire interior double page in tabloid format.

One particular advantage of the latter two described preferred embodiments is that webs of print substrate of special width, and, in the case of newspaper products, especially paper rolls of special width, are not required. For example, using a web having a total web width that corresponds to the height of six tabloid pages, it is sufficient to separate off a partial web that is one-third the total web width, and to feed this partial web to the plough fold and to the adjustable former. In this case, the adjustable former must be moved laterally so that its former nose is located precisely one-twelfth of the original web width inside the edge of the partial web that is opposite the edge of the partial web which has passed through the plough fold.

BRIEF DESCRIPTION OF THE DRAWINGS

Preferred embodiments of the present invention are represented in the accompanying set of drawings and will be specified in greater detail in what follows.

The drawings show in.

DESCRIPTION OF THE PREFERRED EMBODIMENT

Figure 1:
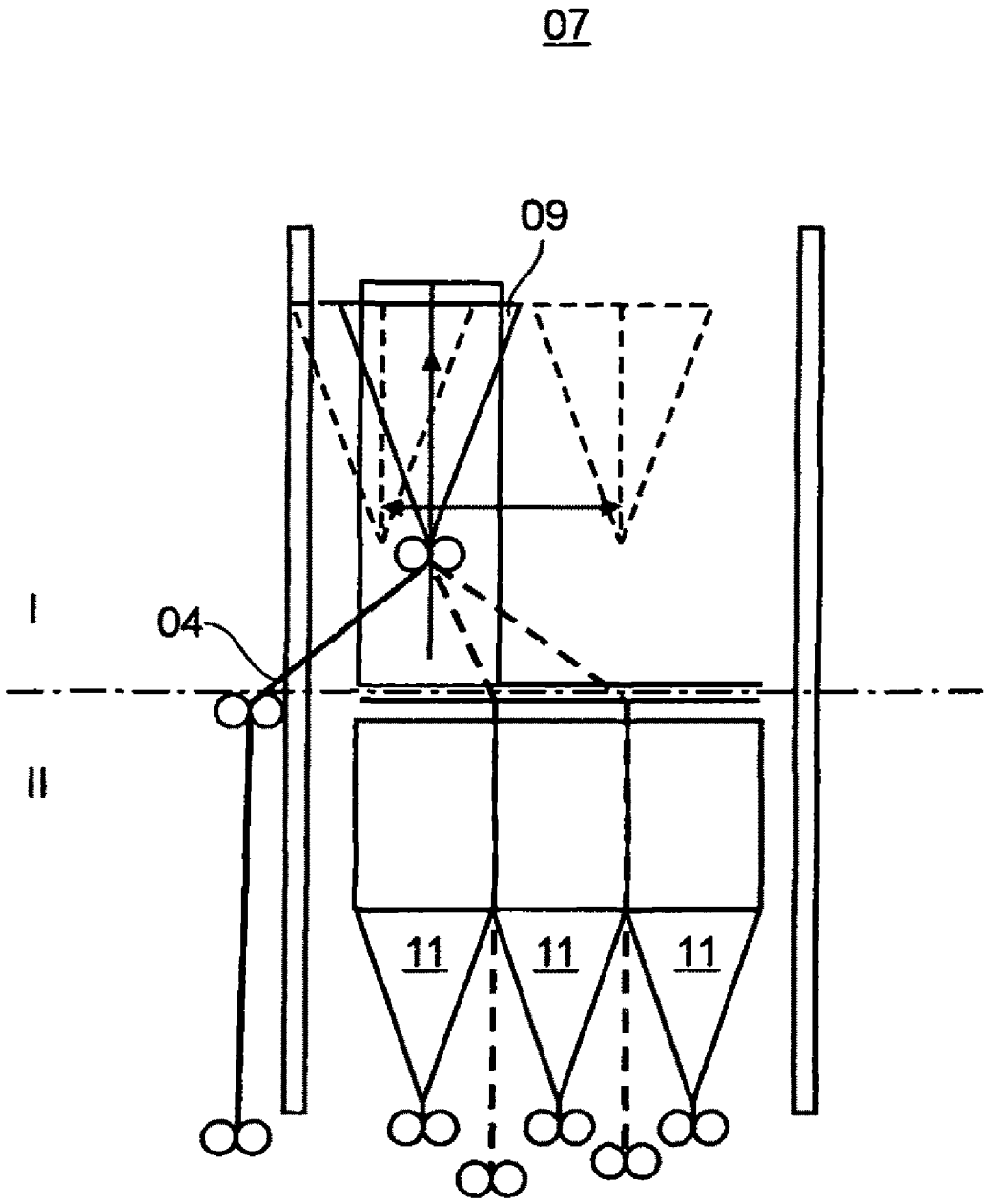
FIG. 1 a schematic representation of a folding unit of a rotary printing press and having a balloon former, which balloon former can be adjusted transversely to the direction of web travel, and opposite to the direction of web travel in the viewing direction.
Figure 2:
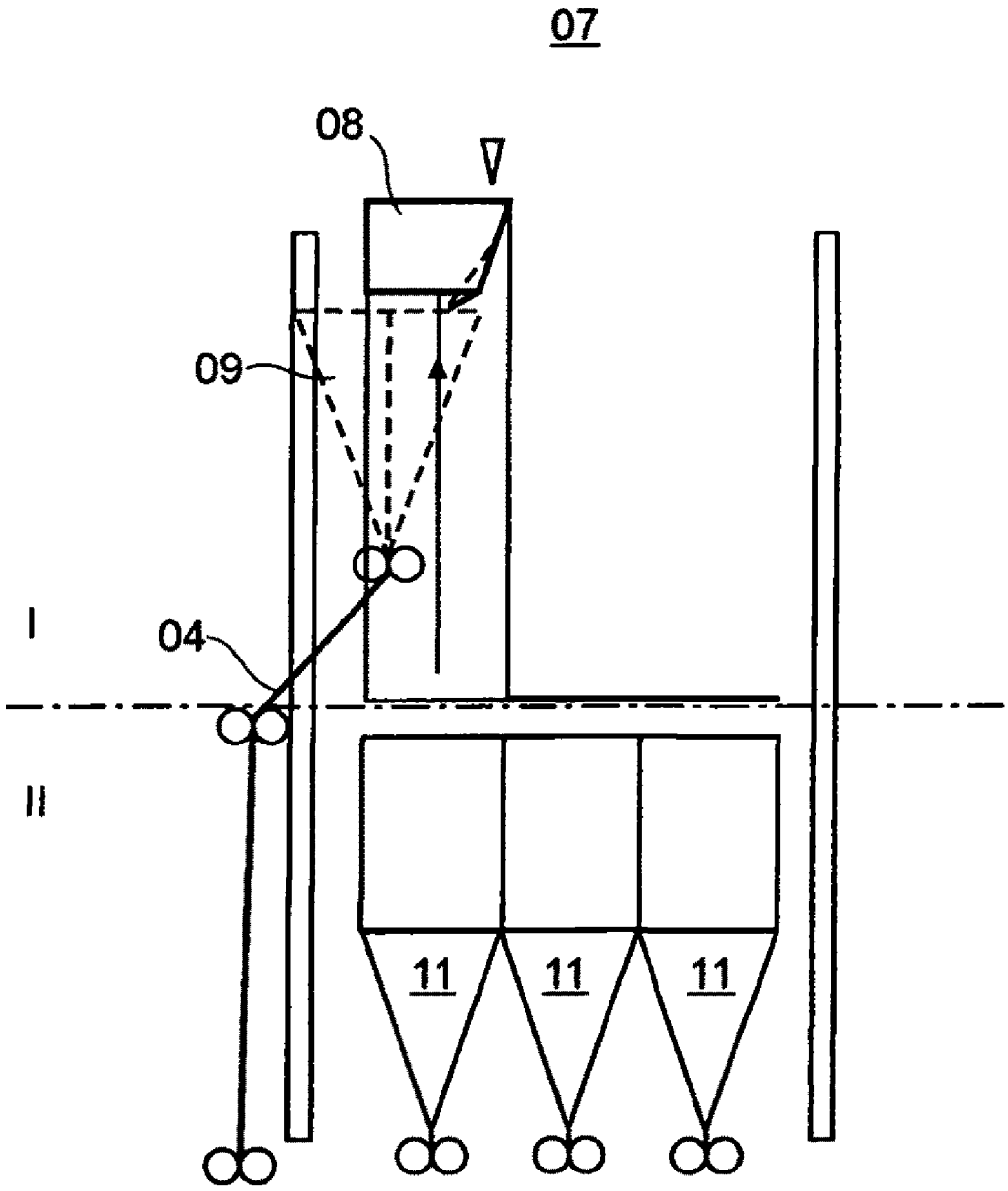
in FIG. 2 a schematic representation of the folding unit of FIG. 1 and with a balloon former, which balloon former can be adjusted transversely to the direction of web travel and which is situated downstream from the plough fold.
Figure 3:
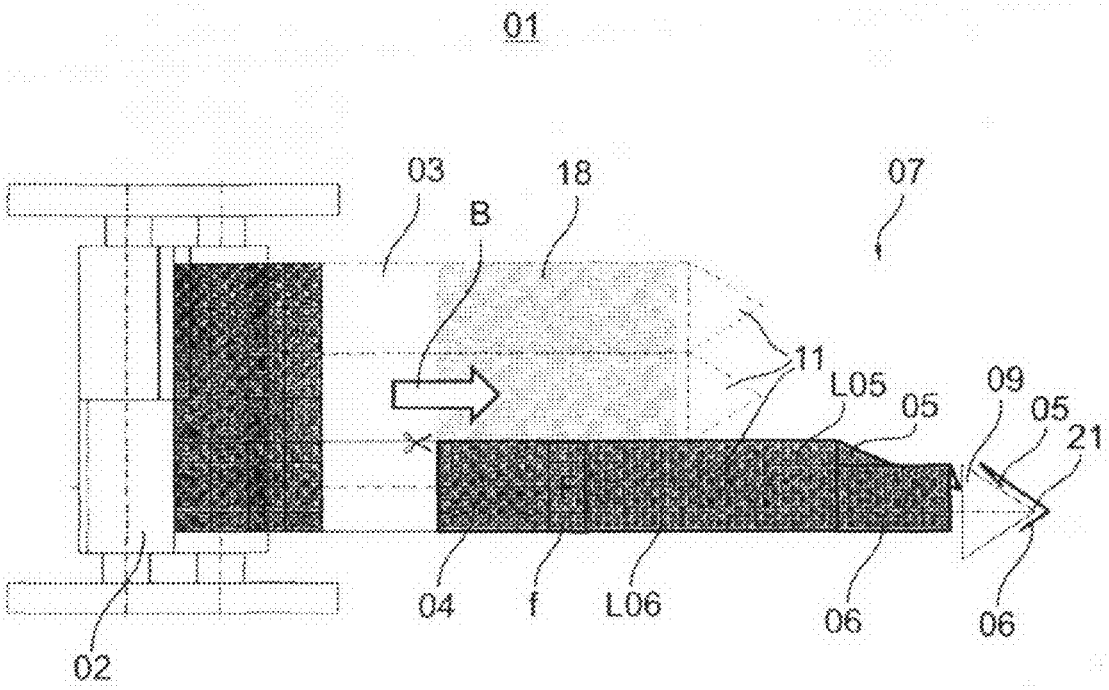
in FIG. 3 a schematic representation of a rotary printing press, in a top plan view, which rotary printing press includes the folding unit of FIGS. 1 and 2.

A rotary printing press 01 is represented schematically in FIG. 1 through 3 and comprises substantially a printing unit 02, as seen in FIG. 3, which prints a web of material 03, such as, for example, a web of paper, or a web 03, with printed pages in a horizontal tabloid format F. A partial web 04, which is obtained by longitudinally cutting the printed web 03, is printed over at least one-half its width with a printed page in a horizontal tabloid format F, the width of which printed page corresponds to the height of one page, and specifically to one tabloid page. The partial web 04 is also printed in remaining first and second edge areas 05; 06. These first and second edge areas 05; 06, respectively, are adjacent to both sides of the horizontal tabloid format F, the width of which horizontal tabloid format F corresponds to the height of one page. Each such edge area 05; 06 is printed with, for example, a narrower printed image section "f". The rotary printing press, which is depicted schematically at 01 in FIG. 3, further comprises a folding unit 07 with a plough fold 08, as may be seen in FIG. 2, which plough fold 08 folds in a first edge area 05 of the partial web 04, that first partial web 04 having been obtained by longitudinally cutting the printed web 03. The first edge area 05 is folded by the plough fold 08 along a first fold line L05 as seen in FIG. 3. The plough fold 08 makes it possible to produce folded-in portions 17, which can be located at the foot 14 or at the head 13 of a newspaper product 12 or a product section 12 in tabloid format, depending upon the location of the plough fold arrangement 08, as shown schematically in FIG. 4.

The folding unit 07 is also equipped with a former 09, and is especially equipped with a balloon former 09. Former 09 is situated downstream from the plough fold 08 in a direction of travel of web 03. Former 09 is adjustable at least transversely, for example, and optionally is also adjustable lengthwise, with respect to the direction of web travel B, and is movable transversely, for example, over the entire web width. The former is capable of folding in a second edge area 06, which is located on the side of the partial web 04 opposite the first edge area 05, with the second edge area 06 being folded along a second fold line L06, and in the same fold direction as the first folded-in edge area 05. For purposes of simplification, FIG. 1 shows only the balloon former 09, which can be adjusted transversely to the direction of web travel B, without the associated plough fold 08, which is depicted in FIG. 2. The balloon former 09, which can be adjusted transversely to the direction of web travel B, for example, makes it possible to produce folded-in portions 17 which can be located either at the head 13 or at the foot 14 of a newspaper product 12 in tabloid format, depending upon the location of the arrangement of the plough fold 08 and the former 09, as may be seen in FIG. 4.

As an example of folded-in edge portions 05; 06 on both sides of a partial web 04, FIG. 3 shows a corresponding printing pattern on the partial web 04 comprising a horizontal printed page in tabloid format F, and a shorter, when viewed in the direction of web width or narrower printed image section "f" on both sides of this printed page. The printed image sections "f" on both sides 05; 06 of the horizontal printed page in tabloid format F can each be of equal length or of different lengths, but both are shorter, in the direction of the web width, than is the horizontal printed page in tabloid format F to which they are connected along their respective fold lines L05; L06.

In FIGS. 3, 7, 9 and 10, the partial web 04 and the former 09 are arranged relative to one another, in the area in front of the former 09, in such a way that the partial web 04, which has been folded-in on one side 05 or 06 by the plough fold 08, approaches the former 09 eccentrically. The center of the partial web 04, which has already been folded in on one side 05 or 06 by the plough fold 08, is offset rather than being aligned with the former nose.

If edge areas 05, 06 of the partial web 04 will be folded in on both sides, the partial web 04, which has already been folded in on one side 05 or 06, and the former 09 are arranged, in relation to one another, in such a way that a second fold line, typically fold line L06, which lies between the printed page in tabloid format F and the second edge area 06, or the corresponding printed image section "f", for example, is aligned with the former nose.

If the partial web 04 contains a printed image section "f" adjacent to the printed page F in tabloid format, and located on only one side of the partial web 04, the process of folding in by the use of the former 09 can be omitted, and the partial web 04 can be, or is fed to only one former leg, which is not specifically shown.

In generally conventional single-balloon former assemblies, the balloon former cannot be shifted transversely to the direction of web travel. Instead, it is customarily permanently attached on the operating side of the rotary printing press.

The folding unit 07, as may be seen in FIGS. 1 and 2, has two former planes I; II, which are situated one above another. The adjustable former 09 is configured as a balloon former 09 which is arranged in an upper former plane I, which upper former plane I is situated above a lower former plane II. This former arrangement allows the partial web 04, which is fed over the plough fold 08 and the balloon former 09, to be placed optionally on top of, underneath, or between the partial webs running over the lower former 11. The result is that the pages 04, that are provided with the folded-in portions 05; 06, can be placed at any location in a newspaper product which can be produced using the rotary printing press 01. To accomplish this placement, the adjustable former 09, which is configured as a balloon former 09, is arranged in alignment above the three formers 11 of the lower former plane II.

Figure 5:
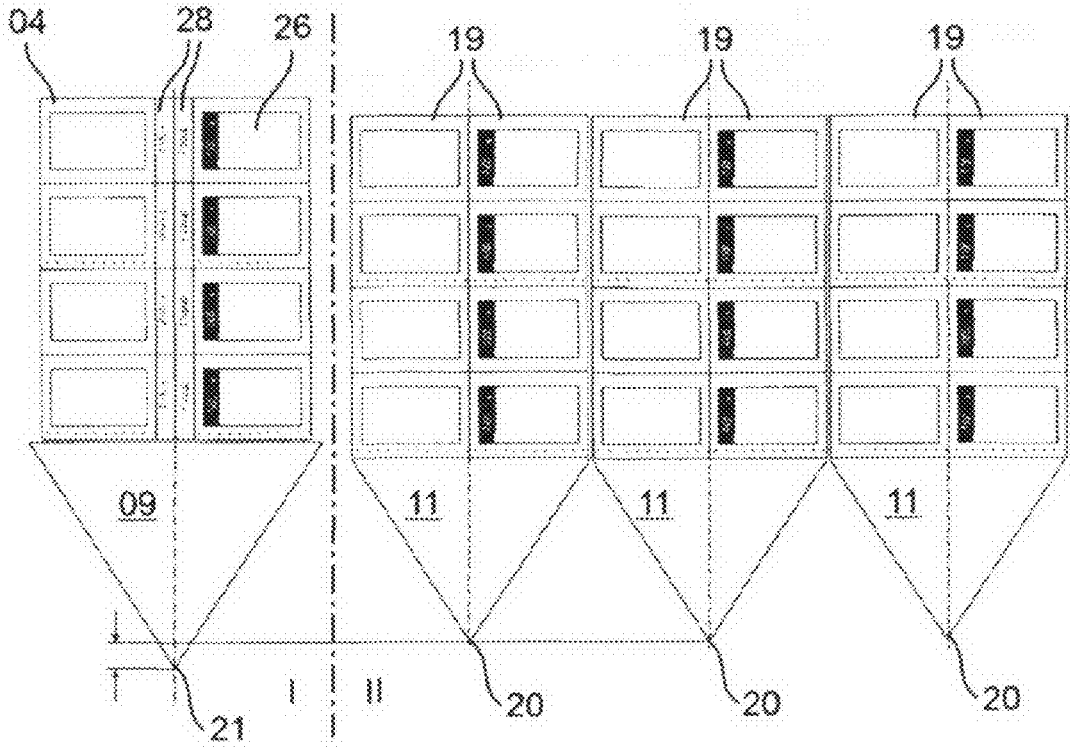
in FIG. 5 a schematic representation of a printing pattern that is required to produce a second newspaper product in tabloid format, with a projection at the head of the page.
Figure 7B:
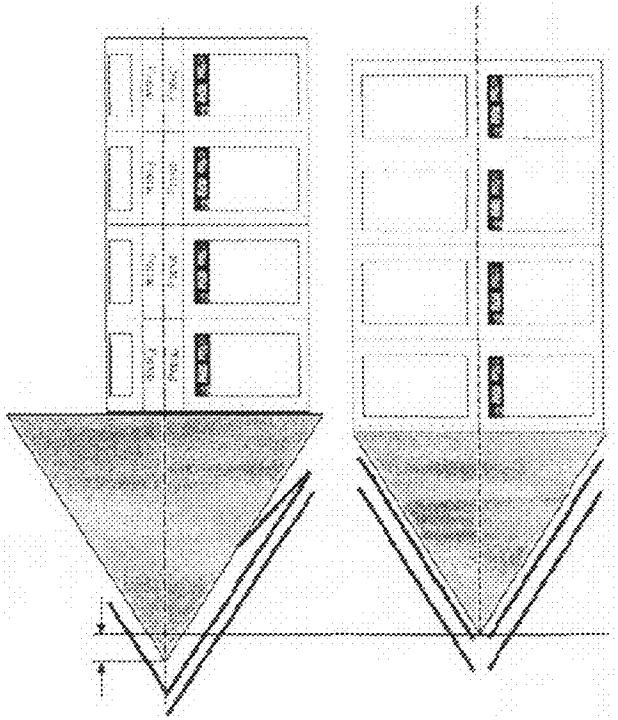
in FIG. 7*a, b* first and second schematic representations, respectively of a printing pattern which is required to produce a third newspaper product in tabloid format, the third newspaper product being configured with a projection at the head of the page and with folded-in portions at the head and at the foot of the page.
Figure 7A:
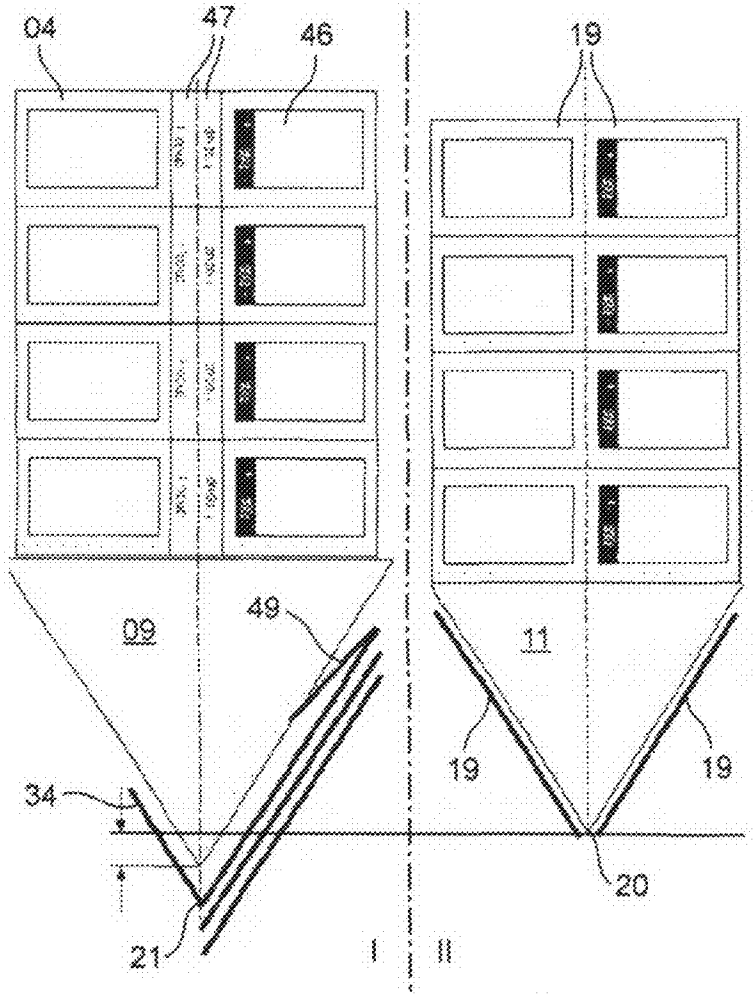

The folding unit 07 of the rotary printing press 01 can also comprise a second longitudinal web cutting device, which is not specifically shown here, and which is operable to longitudinally cut the remainder 18 of the web 03, which, as may be seen in FIG. 3, remains following the separation of the partial web 04 that has been fed over the plough fold 08 and the adjustable former 09 located downstream, into partial webs 19, with the width of each such partial web remainder corresponding to the height of one tabloid page, as is depicted in FIGS. 5 and 7*a, b*. In each case, at least two of these remainder partial webs 19 are fed, side by side, over a former 11 of the lower former plane II, for example, such that a dividing line between the adjacent remainder partial webs 19 runs over the former nose 20 of the respective, for example lower, former 11, as may be seen at the right in FIG. 7*a*.

Figure 4:
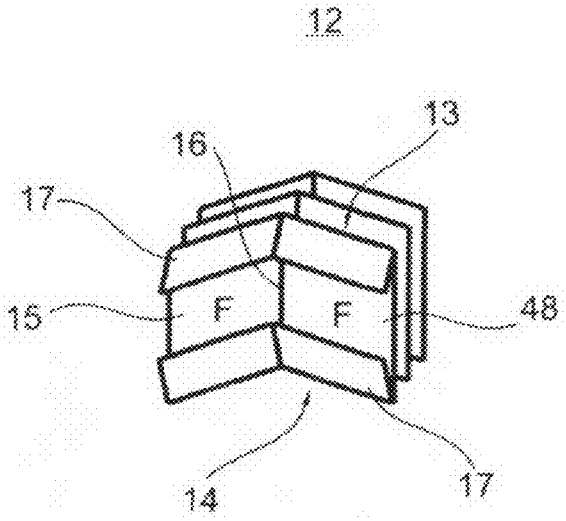
in FIG. 4 a schematic representation of a first newspaper product in tabloid format, which first newspaper product can be produced using the rotary printing press of FIG. 3.

The combination of the upper, preferably balloon former 09, which can be adjusted transversely to the direction of web travel B, for example, and a plough fold 08 makes it possible to produce folded-in portions 17 at both the head 13 and at the foot 14 of a newspaper product 12 in tabloid format, as is shown in FIG. 4. FIG. 3 clearly illustrates how the partial web 04, that has been separated from the web 03 and which has been fed over the plough fold 08, which lies in the upper former plane I, for example, and the former 09, is folded first by the plough fold 08 along line L05 and then is folded by the former 09 along line L06. Former 09 is preferably offset laterally, for example, on the opposite edge of the partial web, so that the fold lines L05; L06 extend in the same direction. The result is that each edge area 05; 06 is folded in on its side, for example on the upper, or lower, side of the web. In one embodiment of the printing press having a plurality of former planes, the former 09 is aligned above the former 11 of the lower former plane II, for example.

Using the rotary printing press 01, a newspaper product 12 in tabloid format, as represented in FIG. 4, with folded-in portions 17 located at the head 13 and/or at the foot 14 of at least one interior page 15 of the newspaper product 12, and with the folded-in portions 17 being folded in the same direction crosswise to a fold spine 16, or a reading fold 16, can be produced from a partial web 04. The partial web 04 has been printed in horizontal tabloid format and is configured to be wider than the height of one tabloid page by the height of the folded-in portion 17, or portions, which is or are situated at the head 13 and/or at the foot 14 of the interior page 15. The newspaper product 12, which is shown in FIG. 4, represents a newspaper product 12, for example, or represents at least a part or a section of a newspaper product, which optionally may be composed of a plurality of sections. After the partial web has been folded, by passing through the former 09, it is joined with the remaining partial webs 19 into a ribbon. That ribbon is divided into product sections 12 by cross cutting the ribbon in a cross cutting device, which is not specifically shown, especially after every second printed image of a printed page in tabloid format. In this case, "F" denotes the pages in the tabloid format F which are vertical in the product. The "opened up" newspaper product 12 has a width of two tabloid pages side by side, which were previously or which are arranged on the forme cylinder of the printing couple 02 as "horizontal" printed pages in tabloid format F on the forme cylinder, one directly in front of another in the circumferential direction. The fold spine 16 of the "closed" newspaper product 12, or of the newspaper section 12, is preferably formed in the rotary printing press by the use of a generally known cross folding device which is located downstream from the cross cutting device. The cross cutting device and/or cross folding device can be a part of a folding unit that is not specifically shown here.

The preferably interior pages 15 can be folded in at the foot 14 of the interior pages 15 by the plough fold 08, and/or can be folded in at the head 13 of the interior pages 15 by a projection over the former nose 21 of the balloon former 09. The location of the fold line produced by the former 09 can be varied by an amount that is dependent upon the lateral position of the balloon former 09 in relation to the center of the partial web 04 entering the plough fold 08, and upon the positioning of the plough fold 08 and the width of the partial web 04.

Although preferably only the head 13 and/or the foot 14 of the interior pages 15, which are typically referred to as the so-called panorama pages 48, are folded inward in this manner, in order to allow the interior pages 15 and their head 13 and/or foot 14 to be unfolded, this process can also be used to separate sections of a newspaper product 12 in tabloid format from one another.

The present invention makes it possible, as a special case, for example, to produce a folded-in portion 17 that spans over the height of both of the interior pages 15 from a partial web 04 that measures ⅓ of the web width, using a 1/12-width plough fold inward fold at the edge area 05 and a 1/12-width projection over the former nose 21 of the balloon former 09, without requiring a paper roll of special width to produce a newspaper product of this type. The present invention makes it possible to produce this type of newspaper product merely by separating a ⅓-width partial web 04 from the web 03 and by feeding this ⅓-width partial web 04 to the balloon former 09. This partial web 04 is preferably moved toward the operating side of the printing press, in relation to a longitudinal center axis of the rotary printing press 01, far enough that the former nose 21 is located precisely 1/12 the width of the web 03 from the web edge on the operating side of the printing press. The adjustment which is used to bring the former nose to precisely 1/12 the web width, from the web edge on the operating side, can especially also be achieved by shifting the balloon former 09.

If the balloon former 09 is configured with extra width, as shown in FIG. 5, taller interior pages 25, which may be located toward the inside of the product 12 can also be produced. This is usable for folding so-called pop-ups, for example.

If this balloon former 09 can also be shifted longitudinally, with respect to the direction of travel of the incoming ribbon, so-called pop-ups, in the form of projections 23 at the head 24 of an interior page 25 of a newspaper product can be produced. The pin holes, which may be desired in tabloid products, lie not on the title page, but at the back of the product.

Figure 6:
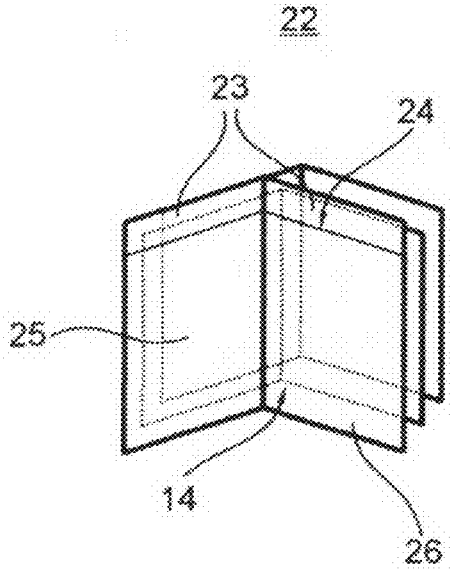
in FIG. 6 a schematic representation of a second newspaper product in tabloid format, with a projection at the head of the page, which second newspaper product can be produced using the rotary printing press of FIG. 3 and the printing pattern of FIG. 5.

A newspaper product 22 resulting from this process, and having a pop-up in the form of a projection 23 at the head 24 of an interior page 25, is shown in FIG. 6.

A printing pattern 26, which is required for this purpose, shown in FIG. 5, provides for a printing format that is wider by the height of the projection 23 on the partial web 04 that is fed over the balloon former 09. To produce the newspaper product 22, such as is shown in FIG. 6, the plough fold 08 is moved out of the direction of travel of the partial web 04, which partial web 04 is now the width of two horizontal tabloid pages plus twice the height of the projection 23. The partial web 04 is again cut longitudinally, in precisely the same manner as are the partial webs 19 that have been fed over the former 11 of the lower former plane II, in the direction of web travel B, before it reaches the former nose 21 of the balloon former 09. Depending upon whether the projection 23 will be located at the head 24 or at a foot 27 of the newspaper product 22, an area 28, that ultimately forms the projection 23, lies at the inside or at the outside of the printing pattern 26 on the partial web 04, as may be seen at the left in FIG. 5.

By folding in the projection 23 on the interior page 25, an interior page, having a pop-up that can be opened up, can be produced at the head 24 of the interior page 25.

Figure 8:
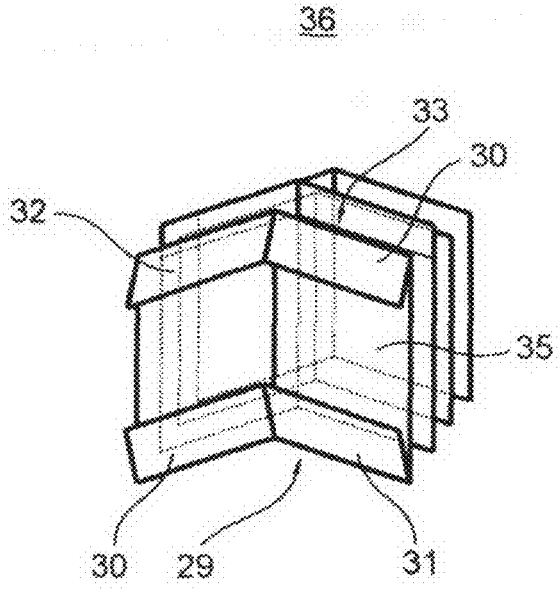
in FIG. 8 a schematic representation of a third newspaper product in tabloid format with a projection at the head of the page and with folded-in portions at the head and at the foot of the page, which can be produced using the rotary printing press of FIG. 3 and the printing pattern of FIG. 7*a, b*.

The provision of so-called pop-ups can be accomplished at both the head 33 and at the foot 29 of an interior page 35 of a newspaper product 36 as is shown in FIG. 7*a, b* and in FIG. 8. By folding a projection 49 toward the inside of the partial web, using the plough fold 08, a folded-in portion 31, that forms a pop-up 30, can be produced at the foot 29 of an interior page 35. As is also shown in FIGS. 7*a, b*, a folded-in portion 32, which is seen in FIG. 8, and that forms a pop-up 30 at the head 33 of the interior page 35, can be formed by folding in a projection 34 over the former nose 21 of the balloon former 09. In this case, the printing pattern 46 looks substantially the same as did the printing pattern 26 which is shown in FIG. 5. The pop-ups 30 depicted in FIG. 8 are also formed by areas 47 in the printing pattern 46, which areas 47 lie at the inside or at the outside of the printing pattern 46 on the partial web 04, depending upon whether the pop-ups 30 will be located at the head 33 or at the foot 29 of the newspaper product 36. The loading of the former is also shown in FIG. 7*a, b*, wherein the balloon former 09 is shown offset. The resulting newspaper product 36 is shown in FIG. 8.

Figure 9:
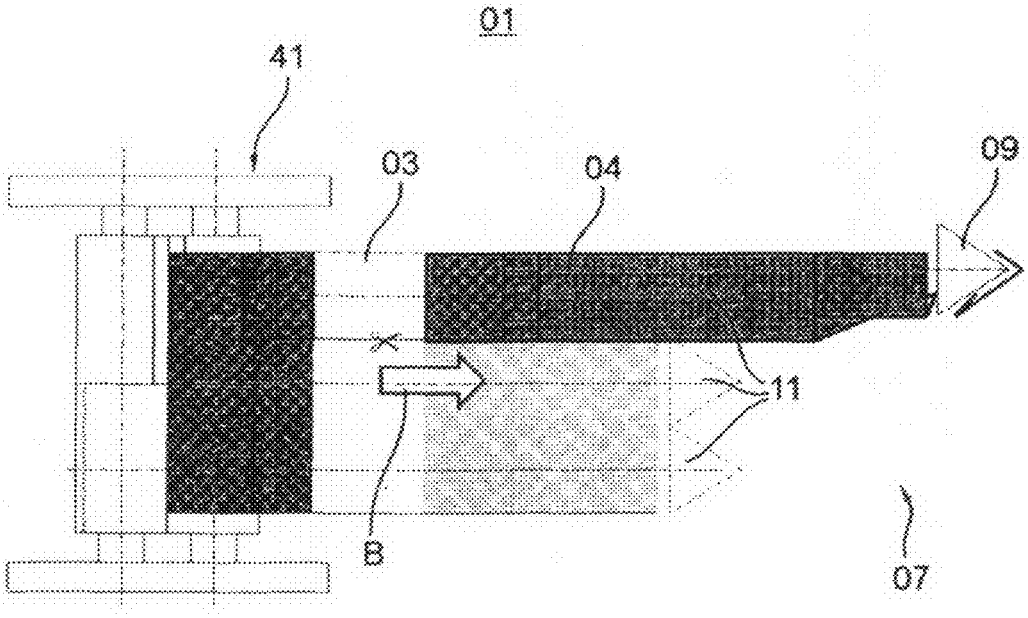
in FIG. 9 a schematic representation of the rotary printing press of FIG. 3 in a top plan view, and with the balloon former moved to the driving side.

As a further variation of the present invention, a folded-in portion 40 for the title page 37 and for the back page 38 of a newspaper product 39 in tabloid format can also be produced by moving the balloon former 09 of the rotary printing press 01 toward the driving side 41 of the rotary printing press 01, as shown in FIG. 9. The partial web 04, which is running over the balloon former 09, can be fed as a cover layer into a folding unit, which folding unit is arranged below the balloon former 09 and which is not specifically shown here. Such a folding unit comprises at least one pair of cutting cylinders, which combine the partial web 04, which has been fed over the plough fold 08 and the adjustable former 09, with the partial webs 19, which have been fed over the former 11 of the lower former plane II of the folding unit 07, to form a ribbon. The resultant ribbon can then be cut crosswise by the cutting cylinders into sections each having a length that corresponds to the width of a double tabloid page. The folding unit additionally comprises at least one pair of folding cylinders, which fold the sections crosswise to the direction of web travel B.

Figure 10:
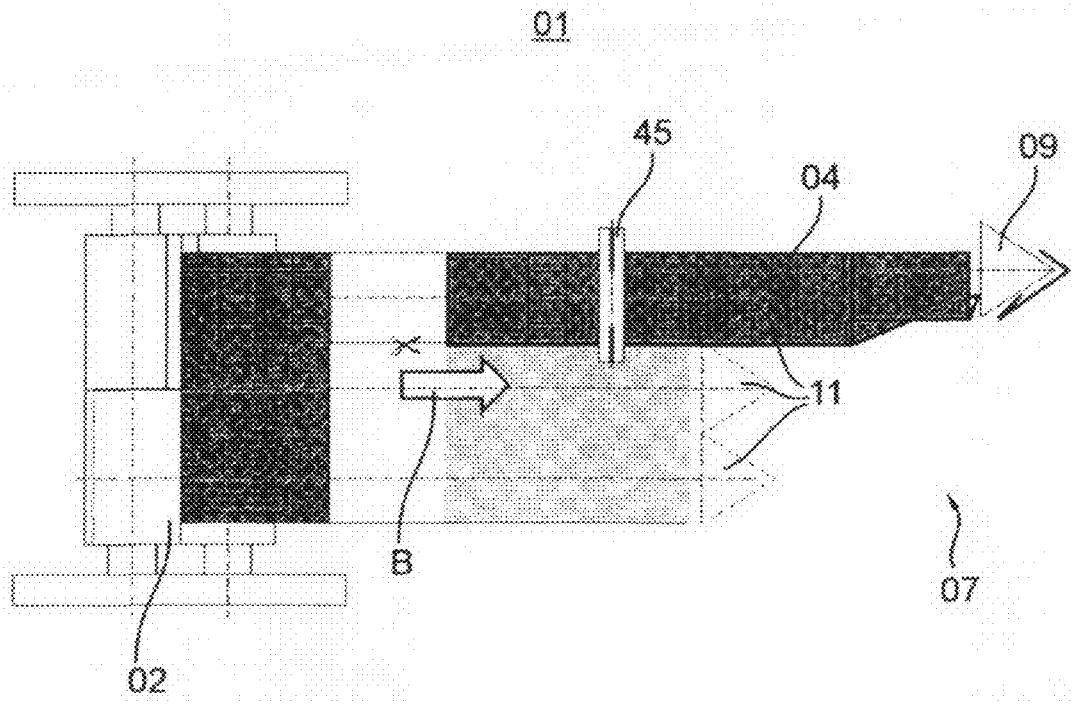
in FIG. 10 a schematic representation of the rotary printing press of FIG. 9 in a plan view, with the inclusion of an additional perforation device.

The folded-in portion 40 could be opened only if the newspaper product 39 were fully opened up. However, if a rhythmically running device 45, configured especially as a perforation device and/or as a cutting device 45, and which perforates or cuts through the folded-in portion 40 in the area of the cross fold or reading fold 42, is additionally arranged upstream from the balloon former 09 in the direction of web travel B, as is shown in FIG. 10, the folded-in portion 40 positioned at the head 43 of the title page and the back page 37; 38 and/or at the foot 44 of the title page and the back page 37; 38, respectively, can be opened up even if the newspaper product 39 is not opened.

Figure 11:
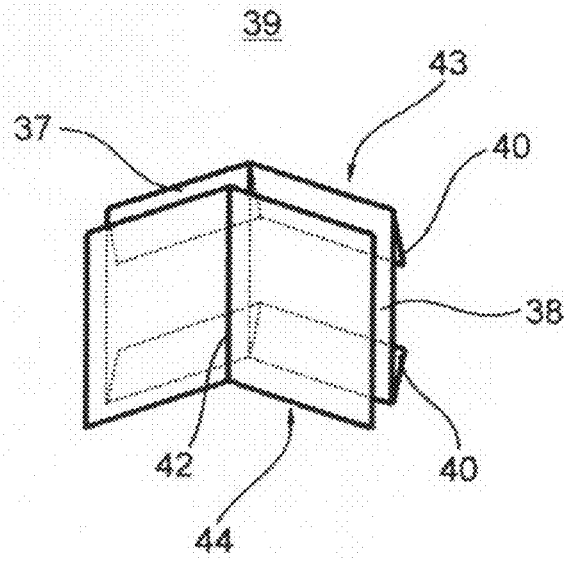
in FIG. 11 a schematic representation of a fourth newspaper product in tabloid format with folded-in portions that can be individually opened up at the head and at the foot of the page on a title page, and which fourth newspaper product in tabloid format can be produced using the rotary printing press of FIG. 10; and in FIG. 12 a schematic representation of a fifth newspaper product in tabloid format with folded-in portions at the head and at the foot of the page, which folded-in portions can be opened up individually on an interior page, which can be produced using the rotary printing press in accordance with the present invention.

A finished newspaper product 39 can appear as is shown schematically in FIG. 11. The folded-in portion 40 is perforated in the area of the cross fold that forms the reading fold 42. This will allow the folded-in portion 40 to be separated and opened up, even if the newspaper product 39 is closed.

Figure 12:
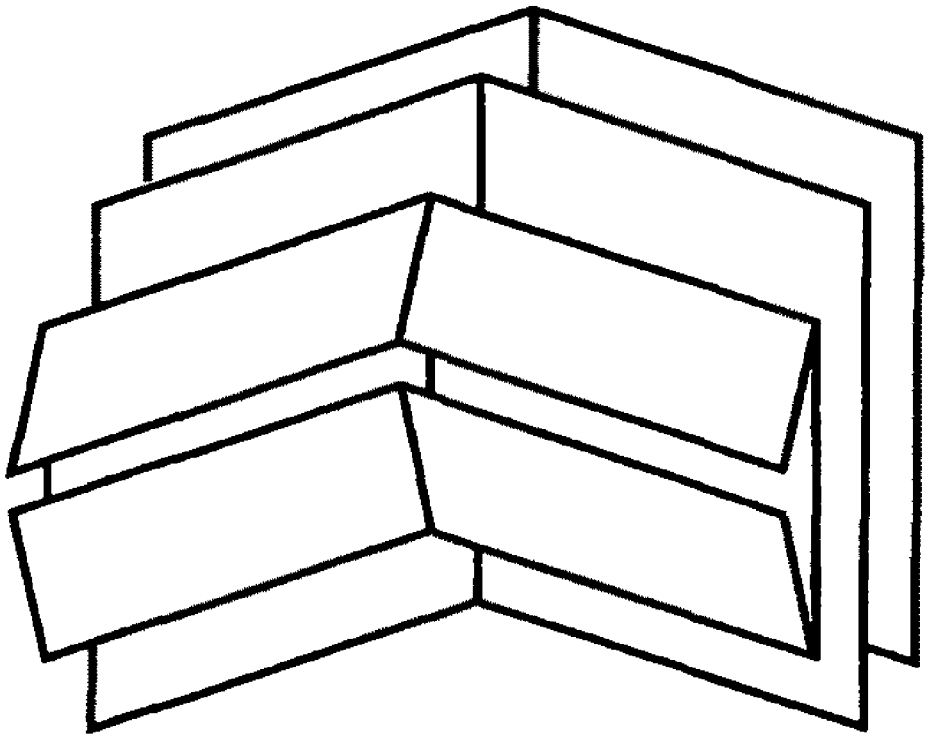

The folded-in pages could also be made shorter, for example, by the amount of the folded-in portion. In other words, by unfolding the folded-in portion, a normal height tabloid page would be formed, for example. It is also possible for the page height to be shorter than the normal tabloid page height when folded in, and taller than the normal tabloid page height when unfolded, as is depicted in FIG. 12.

While preferred embodiments of a rotary printing press and method for producing a newspaper product in tabloid format, in accordance with the present invention, have been set forth fully and completely hereinabove, it will be apparent to one of skill in the art that various changes could be made, for example in the structure of the printing units and their drives, in the structure of the associated folding unit and the like without departing from the true spirit and scope of the subject invention which is accordingly to be limited only by the appended claims.

What is claimed is:

1. A rotary printing press (01) for producing a newspaper product (12; 22; 36; 39) in tabloid format, with at least one printing couple of a printing unit (02), and wherein the at least one printing couple is embodied so as to print a web (03) with printed pages in a horizontal tabloid format (F), with a partial web (04), which is obtained by cutting the printed web (03) longitudinally, and with a plough fold (08), which is arranged in the path of travel of the partial web (04) in such a way that the plough fold (08) folds in a first edge area (05) of the partial web (04), which first edge area (05), that is printed with a narrower printed image section, is folded along a first fold line (L05) as a folded-in portion (17; 30; 31; 32; 40), and with a former having a former nose and first and second former sides (09), and which former is located downstream from the plough fold (08), characterized in that the partial web (04) is printed with only one horizontal printed page in tabloid format (F), the narrower printed image section which is located on at least one side of this horizontal printed page, with the narrower printed image section (f) and the one horizontal printed page in tabloid format being side by side, and that the partial web (04) and former (09) are arranged, in relation to one another, in the area in front of the former (09), in such a way that the partial web (04), which is folded in on one side by the plough fold (08), approaches the former (09) eccentrically, with the center of the partial web (04), which is folded in on one side by the plough fold (08), offset, rather than aligned with the former nose.

2. The rotary printing press (01) according to claim 1, characterized in that the partial web (04) has a second edge area (06) on a side of the partial web (04) which is opposite from the narrower printed image section on the first edge area (05).

3. The rotary printing press (01) according to claim 2, characterized in that the second edge area (06) is printed with a printed image section (f) that is narrower than the horizontal printed page in tabloid format (F).

4. The rotary printing press (01) according to claim 2, characterized in that the partial web (04) and the former (09) are arranged in relation to one another such that the former (09) folds in the second edge area (06), which second edge area is opposite from the first edge area and the narrower printed image section (05).

5. The rotary printing press (01) according to claim 2, characterized in that the partial web (04), which is folded in on one side, and the former (09) are arranged in relation to one another in the area before the former (09), such that a second fold line (L06), which is formed especially between the printed page in tabloid formal and the second edge area (06), is aligned with the former nose.

6. The rotary printing press (01) according to claim 2, characterized in that the width of the web (03) printed by the printing couple of the printing unit (02) is an even-numbered multiple of the height of one tabloid page, from which web (03) at least one partial web (04), the width of which corresponds to the height of two tabloid pages, is obtained via longitudinal cutting, which at least one partial web (04) can be fed to the plough fold (08) with the former (09) located downstream, wherein the former (09) is an adjustable former, and further wherein the total of the widths of the edge areas (05; 06) folded in by the plough fold (08) and the adjustable former (09) corresponds to the height of one tabloid page, in order to produce folded-in portions at least at one of the head (13) and at the foot (14) of an interior page (15; 48) of the newspaper product (12), which portions cover an entire interior page of the newspaper product (15; 48).

7. The rotary printing press (01) according to claim 1, characterized in that the former folds in a second edge area of the partial web (04) which is printed with only one horizontal printed page in tabloid format (F) and which partial web is printed, on both sides of this printed page, in the first and second edge areas (05, 06), each with a narrower printed image section (f), each of the two edge areas and the one horizontal printed page in tabloid format being side by side.

8. The rotary printing press (01) according to claim 1, characterized in that the partial web (04), which is folded in on one side, and the former (09) are arranged in relation to one another, in the area before the former (09), such that the partial web (04), which is folded in on one side, is fed over only one of the first and second sides of the former (09).

9. The rotary printing press (01) according to claim 1, characterized in that the former (09) is embodied as an adjustable former and is displaceable at least transversely to a direction of web travel (B).

10. The rotary printing press according to claim 9, characterized in that the adjustable former (09) is configured with extra width, allowing newspaper products (22) having interior pages (25) that are taller than pages on the outside of the product to be produced.

11. The rotary printing press according to claim 9, characterized in that the adjustable former (09) is also arranged so as to be adjustable longitudinally in relation to the direction of web travel (B) of the web (03) or partial web (04).

12. The rotary printing press according to claim 1, characterized in that a folding unit (07) has at least two former planes (I; II), wherein the former (09) is an adjustable former (09) which is embodied as a balloon former (09), and which is arranged in an upper former plane (I).

13. The rotary printing press according to claim 12, characterized in that the adjustable former (09), which is embodied as a balloon former (09), is arranged aligned above former or formers (11) which are located in a lower former plane (II).

14. The rotary printing press according to claim 12, characterized in that the folding unit (07) comprises at least one longitudinal cutting device, which longitudinally cuts a pail (18) of the web (03) that remains following the separation of the partial web (04), which was fed over the plough fold (08) and the adjustable former (09) located downstream, into partial webs (19), with the width of each partial web (19) corresponding to the height of one tabloid page, wherein the folding unit (07) comprises at least one additional former (11), preferably arranged in a lower former plane (II), and over which at least one additional former at least two partial webs (19), which are traveling side by side, with each having the width of the height of one tabloid page, are fed such that the dividing line between the adjacent partial webs (19) runs over a former nose (20) of the lower former (11).

15. The rotary printing press according to claim 12, characterized in that the folding unit (07) comprises at least one pair of cutting cylinders, which combine the web (03) or partial web (04), which has been fed over the plough fold (08) and the adjustable former (09), with additional webs (03) or with additional partial webs (19), which have optionally been fed over at least one additional former (11) of the folding unit (07), to form a ribbon, and which cuts this combination of web (03), partial web (04), additional web (03), or additional partial webs (19) crosswise into sections, the length of which sections corresponds to the width of a double tabloid page, and at least one pair of folding cylinders, which fold the sections transversely to the direction of web travel (B).

16. The rotary printing press according to claim 15, characterized in that the adjustable former (09) is arranged such that the web (03) or partial web (04) with folded-in edge areas (05; 06) can be placed in the ribbon that is entering the pair of cutting cylinders under ones of additional webs (03) or partial webs (19) that have been fed over at least one additional former (11) of the folding unit (07), so that the folded-in portion (17; 30; 31; 32; 40) optionally comes to rest on a panorama page (48) of the newspaper product (12; 22; 36; 39).

17. The rotary printing press according to claim 12, characterized in that the folding unit (07) of the rotary printing press (01) has means (45) for at least one of perforating and slitting open the partial web, which is folded-in, (17; 30; 31; 32; 40) in the area of the cross fold (16; 42).

18. The rotary printing press according to claim 17, characterized in that the means (45) for at least one of perforating and slitting open the partial web which is folded-in (17; 30; 31; 32; 40), in the area of the cross fold, (16; 42) comprises one of a rhythmically running perforation and a cutting device (45), arranged upstream from the adjustable former (09) in the direction of web travel (B).

19. The rotary printing press (01) according to claim 1, characterized in that at least one of the width of the web (03) printed by the printing couple of the printing unit (02), and the width of the partial web (04) obtained by longitudinally cutting the printed web (03), corresponds to the height of two tabloid pages.

20. The rotary printing press according to claim 19, characterized in that the width of the web (03) corresponds to the height of six tabloid pages, and the plough fold (08) and the former (09) each fold in an edge area (05; 06) of the partial web (04) that is one-twelfth the original width of the web, in order to create folded-in portions (17; 30; 31; 32; 40) at the head (13; 24; 33; 43) and at the foot (14; 27; 29; 44) of an interior page (15; 25; 35; 48) of the newspaper product (12; 22; 36; 39), which folded-in portions cover an entire interior page of the newspaper product (15; 25; 35; 48).

21. A method for producing a newspaper product (12; 22; 36; 39) in tabloid format, and having a folded-in portion (17) located at one of a head (13) and at a foot (14) of at least one of an interior page (15) and a back page (38) of the newspaper product (12), including providing at least one printing couple of a printing unit of a rotary printing press (01), printing a web (03) with printed pages in a horizontal tabloid format (F) using the at least one printing couple of the printing unit (02), obtaining a partial web (04) from the printed web (03) by longitudinally cutting the printed web (03), providing a plough ford (08) and using the plough fold (08) for folding a first edge area (05) of the partial web (04), which first edge area (05) is printed with a narrower printed image section, in along a first fold line (L05) and forming a folded-in portion (17; 30; 31; 32; 40), printing the printed image of only one horizontal printed page in tabloid format (F) on the partial web (04) and printing the printed in of at least one narrower printed image section (f), on at least one side of this printed page in the adjacent edge area (05, 06), and locating the narrower printed image section and the horizontal printed page in tabloid format side by side, locating a former downstream of the plough folder, and feeding the partial web (04), which has been folded in on one side, to an area in front of the former (09), which is located downstream from the plough fold (08), eccentrically, with a center of the partial web (04), which is folded in on one side, being offset rather than aligned with a nose of the former (09).

22. The method according to claim 21, further including providing the partial web (04) bearing the printed image of only one horizontal printed page in tabloid format (F), and, further including providing first and second ones of the edge areas, and printing each of the first and second edge areas with a narrower printed image section on both sides of this horizontal printed page in tabloid form at the printed image of a narrower printed image section (f) in each respective one of the first and second ones of the narrower printed image sections (F) and the horizontal printed page in tabloid format, being located side by side.

23. The method according to claim 22, further including feeding the partial web (04), which is already folded in on one side, to the former (09), and using the former (09) for folding in the second edge area (06), which is opposite the first edge area (05).

24. The method according to claim 21, further including providing the former having two sides, and feeding the partial web (04), which is already folded in on one side, over only one of the two sides of the former (09).

* * * * *

UNITED STATES PATENT AND TRADEMARK OFFICE

CERTIFICATE OF CORRECTION

PATENT NO. : 7,950,640 B2
APPLICATION NO. : 12/311459
DATED : May 31, 2011
INVENTOR(S) : Claus August Bolza-Schunemann et al.

It is certified that error appears in the above-identified patent and that said Letters Patent is hereby corrected as shown below:

Column 11, claim 1, line 23, after "embodied", delete "so";
line 24, before "to", delete "as"; and
line 40, before "the", insert --on--.

Column 12, claim 14, line 62, after "a", change "pail" to --part--.

Column 13, claim 15, line 16, after "additional" (first occurrence), "web" should be --webs--.

Column 14, claim 21, line 6, after "at" (first occurrence) insert --least at--.

Signed and Sealed this
Twenty-third Day of August, 2011

David J. Kappos

David J. Kappos
*Director of the United States Patent and Trademark Office*